US005764594A

United States Patent [19]

Berman et al.

[11] Patent Number: 5,764,594

[45] Date of Patent: Jun. 9, 1998

[54] SILENT ALARM CLOCK

[76] Inventors: Paul Berman, 1650 Tenth St., Santa Monica, Calif. 90404; Neal Marks, 1733 Malcolm Ave. #6, Los Angeles, Calif. 90024; Brad Zieg, 249A Ogle St., Costa Mesa, Calif. 93627

[21] Appl. No.: 651,250

[22] Filed: May 23, 1996

[51] Int. Cl.[6] ..... G04B 47/00; G04B 19/06; G04C 11/02

[52] U.S. Cl. ..... 368/12; 368/47; 368/204; 368/230; 368/250

[58] Field of Search ..... 368/10, 12, 46, 368/47, 52, 230, 72–74, 250, 251; 340/407.1, 825.44

[56] References Cited

U.S. PATENT DOCUMENTS

| | | | |
|---|---|---|---|
| 4,093,944 | 6/1978 | Muncheryan | 368/12 |
| 4,297,677 | 10/1981 | Lewis et al. | 340/148 |
| 4,872,005 | 10/1989 | DeLuca et al. | 340/825.44 |
| 4,873,677 | 10/1989 | Sakamoto et al. | 368/204 |
| 4,920,525 | 4/1990 | Meister | 368/250 |
| 5,072,429 | 12/1991 | Mair | 368/10 |
| 5,144,600 | 9/1992 | Cheng | 368/12 |
| 5,297,118 | 3/1994 | Sakumoto | 368/10 |
| 5,373,488 | 12/1994 | Lidor | 368/13 |

*Primary Examiner*—Vit W. Miska

[57] ABSTRACT

A silent alarm clock including a portable receiver unit with a wrist watch-type configuration. The receiver unit includes a vibrator adapted to create a vibrating sensation upon the receipt of a radio signal. To provide power to the receiver unit a rechargeable battery is included with a pair of associated contacts and a charger adapted to allow the recharging thereof. Also included is a base transmitter unit with a recharging base having a pair of contacts for contacting those of the receiver unit in a recharge orientation. A clock unit is situated within the base transmitter unit having associated control circuitry and a speaker. The clock circuitry is adapted to define at least two predetermined times. The base transmitter unit is adapted to transmit an audio signal via the speaker at a predetermined time if the receiver unit is the recharge orientation thereof and further generate a radio signal via free space if the receiver unit is not in the recharge orientation. Thus, a first user is awakened via the vibrator at the first predetermined time and places the receiver unit within the recharging base thereafter. A second user is then awakened at the second predetermined time via the audio alarm.

2 Claims, 4 Drawing Sheets

SILENT ALARM CLOCK

BACKGROUND OF THE INVENTION

1. Field of the Invention

The present invention relates to a silent alarm clock and more particularly pertains to waking a first user prior to waking a second user.

2. Description of the Prior Art

The use of silent alarms is known in the prior art. More specifically, silent alarms heretofore devised and utilized for the purpose of alerting one person without disturbing others are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. Nos. 4,028,882 to Mucheryan; 4,218,875 to Rothman; 5,043,956 to Tsukada et al.; 5,089,998 to Rund; 4,920,525 to Meister; 4,093,944 to Mucheryan; 5,023,853 to Kawata et al.; 4,456,387 to Igarashi; and 5,282,181 to Entner et al.

In this respect, the silent alarm clock according to the present invention substantially departs from the conventional concepts and designs of the prior art, and in so doing provides an apparatus primarily developed for the purpose of waking a first user prior to waking a second user.

Therefore, it can be appreciated that there exists a continuing need for a new and improved silent alarm clock which can be used for waking a first user prior to waking a second user. In this regard, the present invention substantially fulfills this need.

SUMMARY OF THE INVENTION

In view of the foregoing disadvantages inherent in the known types of silent alarms now present in the prior art, the present invention provides an improved silent alarm clock. As such, the general purpose of the present invention, which will be described subsequently in greater detail, is to provide a new and improved silent alarm clock which has all the advantages of the prior art and none of the disadvantages.

To attain this, the present invention essentially comprises a device to be utilized by a first user and a second user where the first user is awakened prior to the second user. Such device includes a portable receiver unit. The receiver unit has a housing with an interior space and a pair of bands coupled thereto. A pair of pile fasteners are situated at ends the bands for allowing the securemrent of the receiver unit to a wrist of the first user. The receiver unit includes a vibrator situated within the interior space of the housing. The vibrator includes a motor and a disk-shaped weight eccentrically coupled to a rotor thereof. The vibrator is adapted to create a vibrating sensation upon the receipt of an activation signal. For allowing the receipt of radio signals via free space, a receiver is included with an associated decoder situated within the interior space of the housing and electrically connected between an antenna and the vibrator. The decoder affords the transmission of the activation signal only upon the receipt of a predetermined radio signal. To provide power to the receiver unit, a rechargeable battery is included with a pair of associated contacts and a charger adapted to allow the recharging of the battery upon the application of power to the contacts. As best shown in FIG. 1, a base transmitter unit has a horizontally oriented bottom portion with a top face, a bottom face, and a periphery formed therebetween. The base transmitter unit also has a vertically oriented top portion with a front face, a rear face, and a periphery formed therebetween wherein both portions together define an interior space. The base transmitter unit also includes a recharging base having a pair of contacts situated on a top surface of the vertically orientated portion of the housing. A lip is formed about the contacts for maintaining communication between the contacts of the receiver unit and the contacts of the base unit during recharging. A recharge button is positioned on the top surface of the top portion of the housing adjacent the contacts. working in conjunction with the recharge button is a remote charge sensor situated within the interior space of the base for generating a charge signal upon the depression of the recharge button during charging. Also included within the base housing is a clock unit having associated control circuitry adapted to generate a current time signal and allow the generation of both an audio alarm signal and a remote alarm signal at a first predetermined time and a second predetermined time. A clock display is situated on the front face of the vertically oriented portion of the housing for displaying numerical data representative of the current time signal. Control keys are included for allowing a user to define the first predetermined time and second predetermined time. Situated on the front face of the top portion of the housing is a speaker adapted to generate an audio alarm upon the receipt of the audio alarm signal. A transmitter with an associated encoder is coupled to an antenna and adapted to emit the predetermined radio signal generated by the en coder up on the receipt of the remote alarm signal. A transmitter enabler is coupled between the control circuitry of the clock unit and the transmitter. The transmitter enabler is adapted to allow the communication of the remote alarm signal therebetween only upon the lack of receipt of the charge signal via the remote charge sensor. A speaker disabler is coupled between the control circuitry of the clock unit and the speaker for allowing the communication of the audio alarm signal therebetween only upon the receipt of the charge signal via the remote charge sensor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved silent alarm clock which has all the advantages of the prior art silent alarms and none of the disadvantages.

It is another object of the present invention to provide a new and improved silent alarm clock which may be easily and efficiently manufactured and marketed.

It is a further object of the present invention to provide a new and improved silent alarm clock which is of a durable and reliable construction.

An even further object of the present invention is to provide a new and improved silent alarm clock which is susceptible of a low cost of manufacture with regard to both materials and labor, and which accordingly is then susceptible of low prices of sale to the consuming public, thereby making such silent alarm clock economically available to the buying public.

Still yet another object of the present invention is to provide a new and improved silent alarm clock which provides in the apparatuses and methods of the prior art some of the advantages thereof, while simultaneously overcoming some of the disadvantages normally associated therewith.

Still another object of the present invention is to wake a first user prior to waking a second user.

Lastly, it is an object of the present invention to provide a new and improved silent alarm clock including a portable receiver unit with a wrist watch-type configuration. The receiver unit includes a vibrator adapted to create a vibrating sensation upon the receipt of a radio signal. To provide power to the receiver unit a rechargeable battery is included with a pair of associated contacts and a charger adapted to allow the recharging thereof. Also included is a base transmitter unit with a recharging base having a pair of contacts for contacting those of the receiver unit in a recharge orientation. A clock unit is situated within the base transmitter unit having associated control circuitry and a speaker. The clock circuitry is adapted to define at least two predetermined times. The base transmitter unit is adapted to transmit an audio signal via the speaker at a predetermined time if the receiver unit is the recharge orientation thereof and further generate a radio signal via free space if the receiver unit is not in the recharge orientation. Thus, a first user is awakened via the vibrator at the first predetermined time and places the receiver unit within the recharging base thereafter. A second user is then awakened at the second predetermined time via the audio alarm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
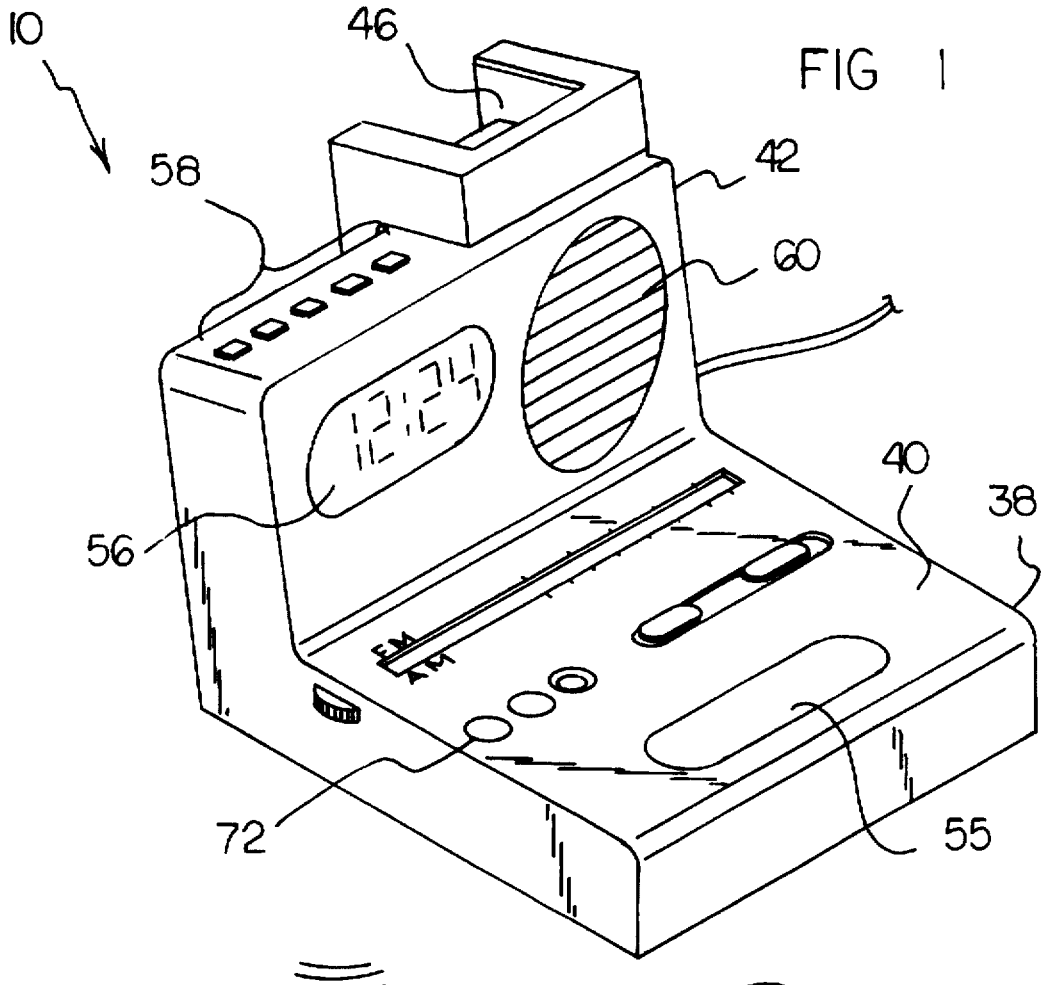
FIG. 1 is a perspective illustration of the preferred embodiment of the silent alarm clock constructed in accordance with the principles of the present invention.
Figure 2:
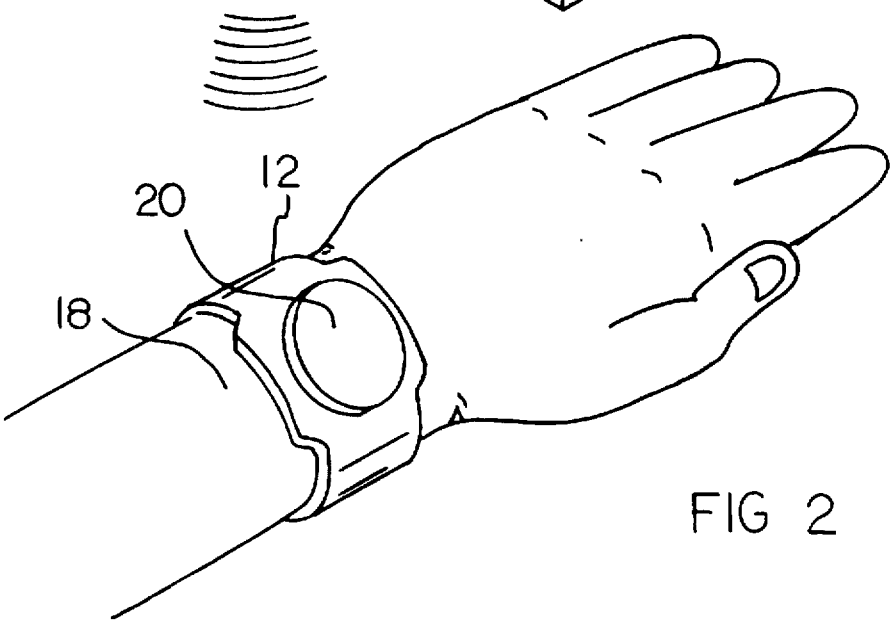
FIG. 2 is a perspective view of the receiver unit.
Figure 3:
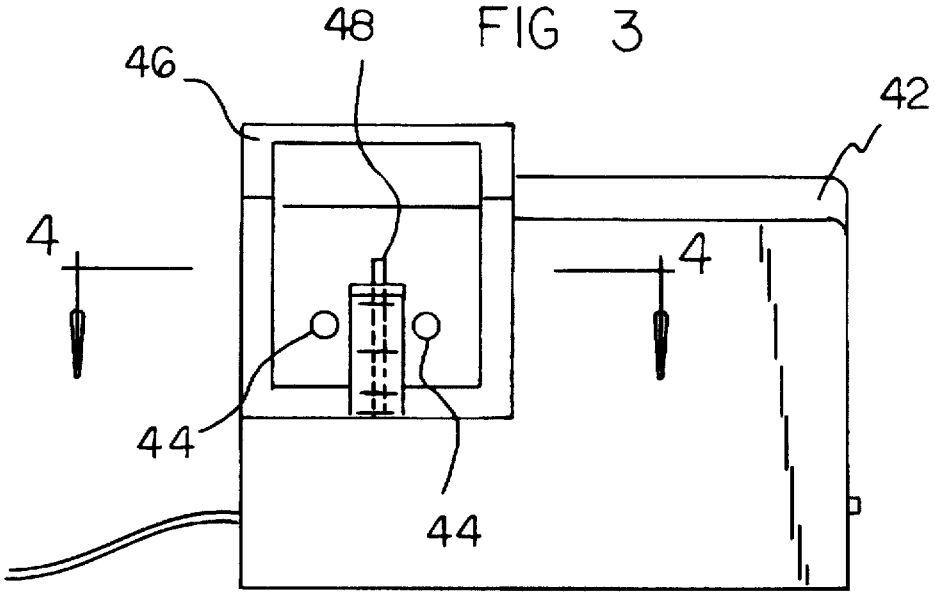
FIG. 3 is a top plan view of the base transmitter unit.
Figure 4:
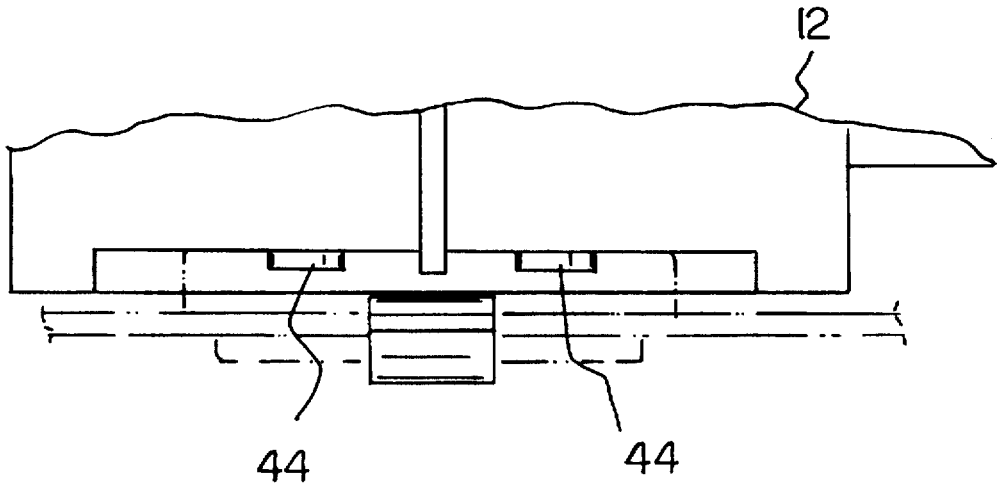
FIG. 4 is a cross-sectional view taken along line 4—4 shown in FIG. 3.
Figure 5:
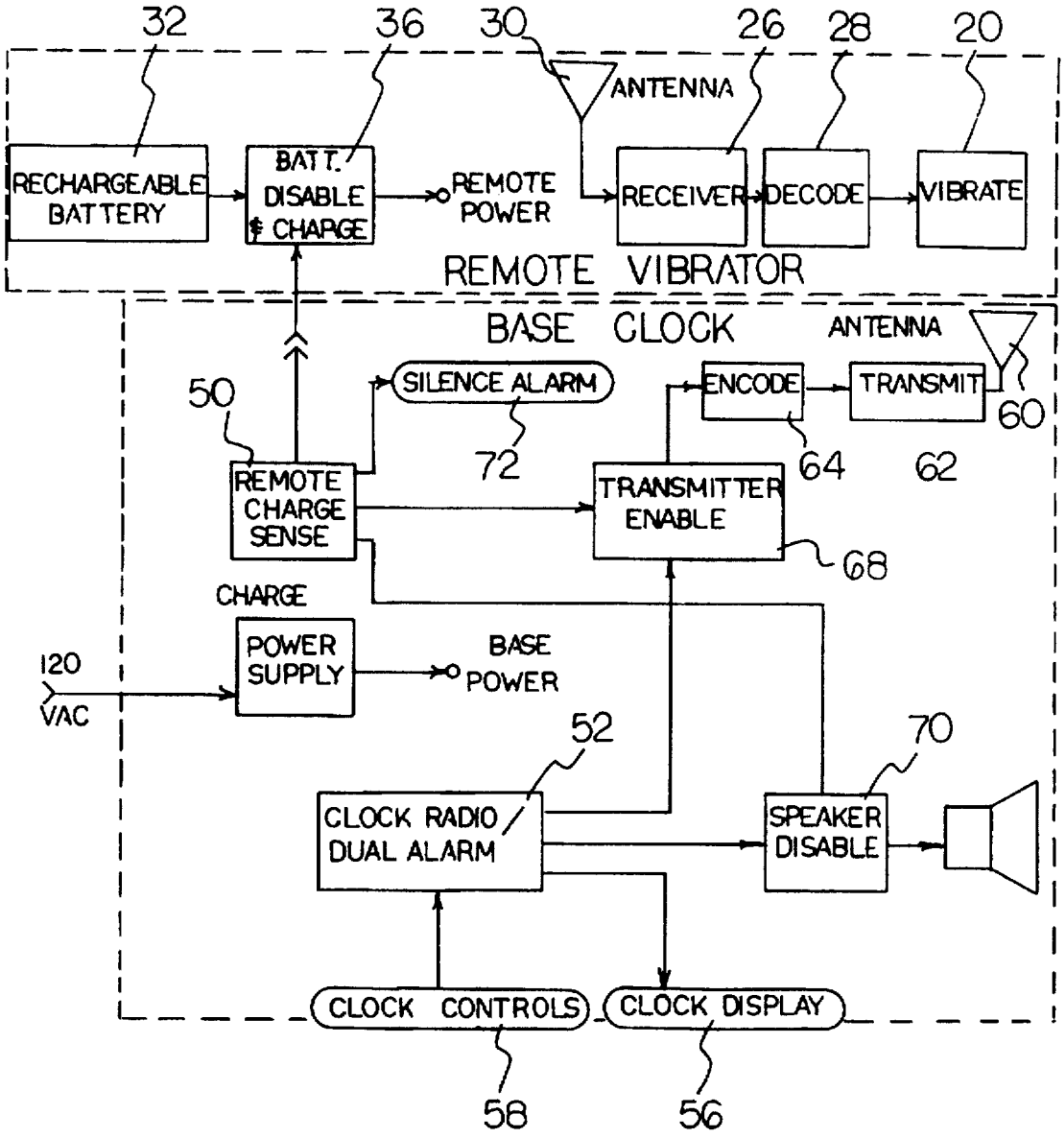
FIG. 5 is a schematic broadly depicting the electrical components employed in the present invention.
Figure 6:
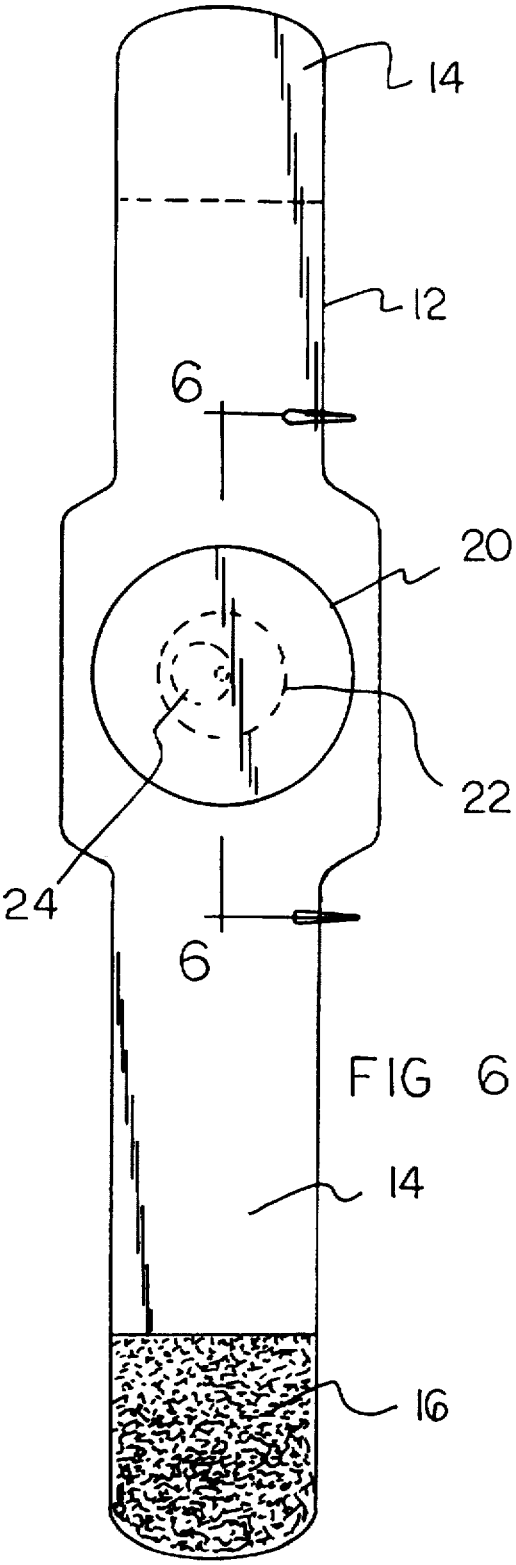
FIG. 6 is atop plan view of the receiver unit.
Figure 7:
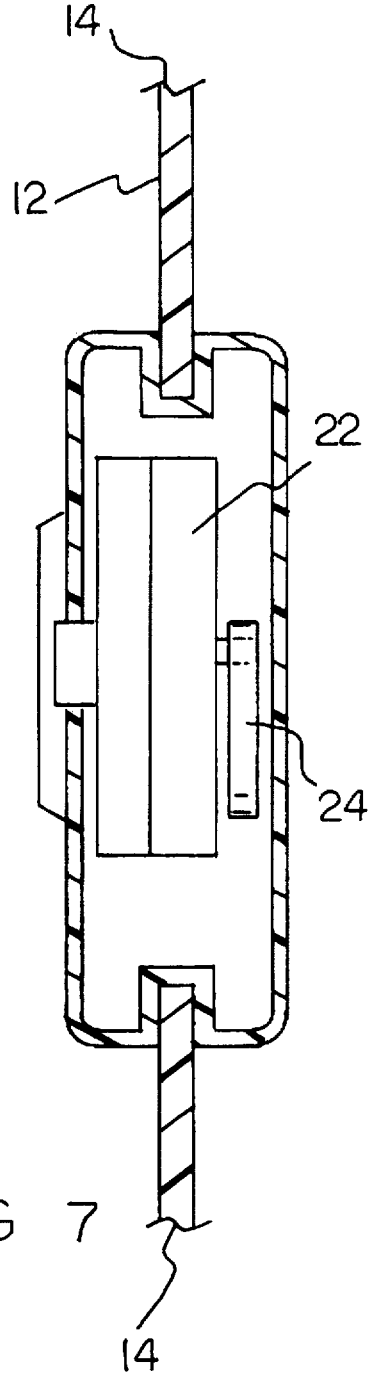
FIG. 7 is a cross-sectional view taken along line 6—6 shown in FIG. 6.

With reference now to the drawings, and in particular to FIG. 1 thereof, a new and improved silent alarm clock embodying the principles and concepts of the present invention and generally designated by the reference numeral 10 will be described.

The present invention, the new and improved silent alarm clock, is comprised of a plurality of components. Such components in their broadest context include a portable receiver unit and a base unit. Such components are individually configured and correlated with respect to each other so as to attain the desired objective.

More specifically, it will be noted that the system 10 to be utilized by a first user and a second user where the first user is awakened prior to the second user includes a portable receiver unit 12. The receiver unit has a housing with an interior space and a pair of bands 14 coupled thereto. A pair of pile fasteners 16 are situated at ends of the bands for allowing the securement of the receiver unit to a wrist 18 of the first user. The receiver unit includes a vibrator 20 situated within the interior space of the housing. The vibrator includes a motor 22 and a disk-shaped weight 24 eccentrically coupled to a rotor thereof. The vibrator is adapted to create a vibrating sensation upon the receipt of an activation signal. For allowing the receipt of radio signals via free space, a receiver 26 is included with an associated decoder 28 situated within the interior space of the housing and electrically connected between an antenna 30 and the vibrator. The decoder affords the transmission of the activation signal only upon the receipt of a predetermined radio signal. To provide power to the receiver unit, a rechargeable battery 32 is included with a pair of associated contacts and a charger 36 adapted to allow the recharging of the battery upon the application of power to the contacts. Ideally, the housing and bands of the receiver unit are light weight and include a cloth covering for allowing the first user to sleep while wearing the present device.

As best shown in FIG. 1, a base transmitter unit 38 has a horizontally oriented bottom portion 40 with a top face, a bottom face, and a periphery formed therebetween. The base transmitter unit also has a vertically oriented top portion 42 with a front face, a rear face, and a periphery formed therebetween wherein both portions together define an interior space. The base transmitter unit also includes a recharging base having a pair of contacts 44 situated on a top surface of the vertically orientated portion of the housing. A lip 46 is included for maintaining communication between the contacts of the receiver unit and the contacts of the base unit during recharging. Preferably, such lip has an L-shaped configuration with a first section situated about the contacts of the base unit for specifically holding the housing of the receiver unit and a second section connected to the first and depending therefrom so as to allow the containment of the bands. A recharge button 48 is positioned on the top surface of the top portion of the housing adjacent the contacts. Working in conjunction with the recharge button is a remote charge sensor 50 situated within the interior space of the base for generating a charge signal upon the depression of the recharge button effected by the securement of the housing within the lip during charging.

Also included within the base housing is a clock unit 52 having associated control circuitry adapted to generate a current time signal and allow the generation of both an audio alarm signal and a remote alarm signal at a first predetermined time and a second predetermined time. A snooze button 55 is included for precluding the generation of both the audio alarm signal and the remote alarm signal for approximately 5–10 minutes upon the depression thereof. A light emitting diode clock display 56 is situated on the front face of the vertically oriented portion of the housing for displaying numerical data representative of the current time signal. Control keys 58 are included for allowing a user to define the first predetermined time and second predetermined time. Such keys may also be employed for other conventional clock functions such as setting the current time. Situated on the front face of the top portion of the housing is a speaker 60 adapted to generate an audio alarm in the form of an electric beeping sound upon the receipt of the audio alarm signal. It should be noted that a radio may be included for allowing the speaker to emit music or other radio programs upon the receipt of the audio alarm signal. A transmitter 62 with an associated encoder 64 is coupled to an antenna 66 and adapted to emit the predetermined radio signal generated by the encoder upon the receipt of the remote alarm signal. A transmitter enabler 68 is coupled between the control circuitry of the clock unit and the transmitter. The transmitter enabler is adapted to allow the communication of the remote alarm signal therebetween only upon the lack of receipt of the charge signal via the remote charge sensor. A speaker disabler 70 is coupled between the control circuitry of the clock unit and the speaker for allowing the communication of the audio alarm signal therebetween only upon the receipt of the charge signal via the remote charge sensor. A LED 72 is connected to the remote charge sensor for emitting light upon the lack of receipt of the charge signal via the remote charge sensor. The encoder and decoder of the present invention are utilized to preclude inadvertent actuation of the present invention due to stray radio signals.

Essentially, both the transmitter enabler and the speaker disabler govern whether the remote alarm signal or the audio alarm signal generated by the control circuitry are employed to effect a silent or audible alarm, respectively. The function of the speaker disabler and the transmitter enabler is, in turn, determined via the remote charge sensor by the presences of the receiver unit in the recharging position thereof. As such, the selection of a silent or audible alarm is conveniently afforded. In use, the first user is awakened via the vibrator at the first predetermined time and places the receiver unit within the recharging base thereafter. The second user is then awakened at the second predetermined time via the audio alarm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved silent alarm clock to be utilized by a first user and a second user where the first user is awakened prior to the second user comprising, in combination:

a portable receiver unit with a housing with an interior space and a pair of bands coupled thereto with a pair of pile fasteners situated at ends thereof for allowing the securement thereof to a wrist of the first user, the receiver unit including a vibrator situated within the interior space of the housing with a motor and a disk-shaped weight eccentrically coupled to a rotor thereof, wherein the vibrator is adapted to create a vibrating sensation upon the receipt of an activation signal; a receiver with an associated decoder situated within the interior space of the housing and electrically connected between an antenna and the vibrator for allowing the receipt of radio signals via free space, wherein the decoder affords the transmission of the activation signal only upon the receipt of a predetermined radio signal, and a rechargeable battery for providing power to the receiver unit, wherein the battery includes a pair of associated contacts and a charger adapted to allow the recharging of the battery upon the application of power to the contacts; and a base transmitter unit having a horizontally oriented bottom portion with a top face, a bottom face, and a periphery formed therebetween and a vertically oriented top portion with a front face, a rear face, and a periphery formed therebetween wherein both portions define an interior space, the base transmitter unit including a recharging base having a pair of contacts situated on a top surface of the vertically orientated portion of the housing with a lip formed about the contacts for maintaining communication between the contacts of the receiver unit and the contacts of the base unit during recharging, a recharge button positioned on the top surface adjacent the contacts, and a remote charge sensor situated within the interior space of the base for generating a charge signal upon the depression of the recharge button during charging; a clock unit having associated control circuitry adapted to generate a current time signal and allow the generation of both an audio alarm signal and a remote alarm signal at a first predetermined time and a second predetermined time, a clock display situated on the front face of the vertically oriented portion of the housing for displaying numerical data representative of the current time signal, control keys for allowing a user to define the first predetermined time and second predetermined time; a speaker adapted to generate an audio alarm upon the receipt of the audio alarm signal; a transmitter with an associated encoder coupled to an antenna wherein the transmitter is adapted to emit the predetermined radio signal generated by the encoder upon the receipt of the remote alarm signal; a transmitter enabler coupled between the control circuitry of the clock unit and the transmitter and adapted to allow the communication of the remote alarm signal therebetween only upon the lack of receipt of the charge signal via the remote charge sensor; and a speaker disabler coupled between the control circuitry of the clock unit and the speaker for allowing the communication of the audio alarm signal therebetween only upon the receipt of the charge signal via the remote charge sensor;

whereby the first user is awakened via the vibrator at the first predetermined time and places the receiver unit within the recharging base thereafter and further the second user is awakened at the second predetermined time via the audio alarm.

2. A silent alarm clock comprising:

a portable receiver unit including a silent awakening means adapted to awaken a user upon the receipt of an activation signal and receiving communication means coupled to the silent awakening means and adapted to afford the transmission of the activation signal only upon the receipt of a predetermined communication signal;

a base transmitter unit a clock unit having associated control circuitry adapted to generate a current time signal and allow the generation of a remote alarm signal at a predetermined time, a clock display for displaying numerical data representative of the current time signal, and transmitting communication means adapted to transmit the communication signal upon the receipt of the remote alarm signal;

wherein the control circuitry of the clock unit is adapted to generate the remote alarm signal at a first predetermined time and an audio alarm signal at a second predetermined time and the base unit further comprises a speaker adapted to generate an audio alarm upon the receipt of the audio alarm signal, whereby a first user is awakened via the silent awakening means at the first predetermined time and a second user is awakened at the second predetermined time via the audio alarm.

* * * * *